United States Patent [19]

Fuchs, Jr.

[11] 4,028,028

[45] June 7, 1977

[54] SLIDING VANE FLUID DEVICE

[75] Inventor: Francis Joseph Fuchs, Jr., Princeton Junction, N.J.

[73] Assignee: Western Electric Company, Inc., New York, N.Y.

[22] Filed: Apr. 9, 1976

[21] Appl. No.: 675,439

[52] U.S. Cl. ..... 418/219; 418/232

[51] Int. Cl.[2] ..... F04C 15/02; F04C 1/00

[58] Field of Search ..... 418/211, 219, 229, 231, 418/232, 77

[56] References Cited

UNITED STATES PATENTS

| | | | |
|---|---|---|---|
| 2,154,456 | 4/1939 | Knapp | 418/219 |
| 2,646,753 | 7/1953 | Zoll | 418/219 X |
| 3,489,126 | 1/1970 | Regar | 418/219 X |

*Primary Examiner*—Carlton R. Croyle
*Assistant Examiner*—Leonard Smith
*Attorney, Agent, or Firm*—A. S. Rosen

[57] ABSTRACT

A reversible fluid device (motor/pump) of the sliding vane type, in which the vanes slide in radial slots formed through the cylindrical periphery of a rotor from side to side in a direction parallel to the axis of rotation of the rotor. Sliding of the vanes is effected by opposed complementary cam surfaces at either end of a cylindrical chamber within which the rotor rotates. The periphery of the rotor and a top edge of each vane, are maintained in constant sliding contact with the cylindrical chamber wall. Opposed edges of the vanes are in constant contact with the cam surfaces. Thus, as the rotor rotates, the vanes, rotor, chamber and cam surfaces define varying volume pressure cells. Selective pressurization of these cells via fluid conductors rotates the rotor (motor operation); rotation of the rotor selectively pressurizes the conductors (pump operation).

8 Claims, 15 Drawing Figures

FIG. 2
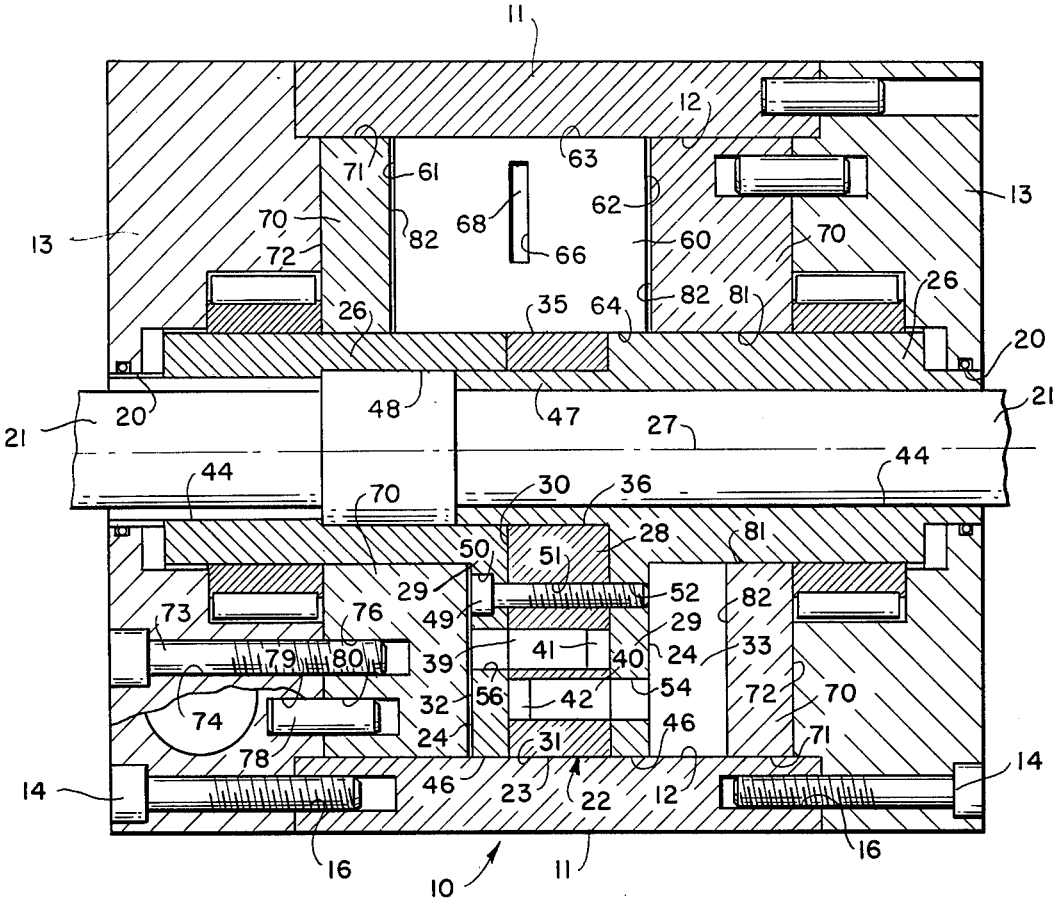
FIG. 4
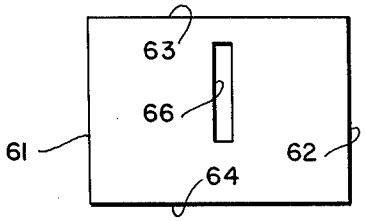
FIG. 4B
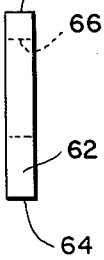
FIG. 4C
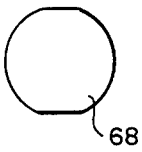
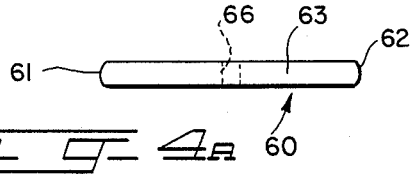
FIG. 4A

22

SLIDING VANE FLUID DEVICE

BACKGROUND OF THE INVENTION

1. Field of the Invention

This invention relates to rotary fluid devices, and more particularly to a rotary fluid device of the sliding van type. The term, "fluid device", as used herein, may be taken to mean any apparatus for converting between mechanical and fluid power, and encompasses fluid pump and/or fluid motor devices.

2. Description of the Prior Art

Rotary fluid devices of the sliding vane type are well known, and are typified, inter alia, by three prior art references, described below.

A first type of rotary fluid device is described in U.S. patents to Erickson (U.S. Pat. No. 3,586,466) and to Rosen (U.S. Pat. No. 2,393,223). In general, a right circular cylindrical rotor is rotatably and concentrically mounted in a cylindrical chamber formed in a housing. Portions of the cylindrical chamber wall conform to the cylindrical rotor periphery, while other wall portions are enlarged in a direction away from the rotor axis to define pressure chambers between the rotor periphery and the enlarged chamber wall portions. The rotor contains plural radial slots at regular intervals through its periphery. A generally planar vane is slidably held in each slot so that the opposed end edges of each vane are coincident with the ends of the rotor. These opposed end edges and the rotor ends are in continuous, sliding and sealing engagement with end caps which close the chamber. The vanes are radially slidable in the slots toward the axis of rotor rotation, until an outer edge thereof is coincident with the cylindrical rotor surface, when they are opposite the conformal portions of the chamber wall. When the vanes are opposite the enlarged portions (i.e., in the pressure chambers) of the chamber wall, they are free to slidably move away from the rotor axis until their outer edges abut the surface of the enlarged portions. A pair of passages communicate with each pressure chamber and means are provided for urging the vanes radially outwardly to maintain their outer edges in constant contact with the chamber wall. Thus, between each vane a variable volume pressure cell is formed, the volume of which varies as the rotor rotates and the cells are successively moved through the pressure chambers.

In use as a motor, one passage in each pressure chamber is connected to a source of fluid under pressure, the other to a low pressure fluid reservoir. The outwardly urged vanes are acts on by the fluid as it moves from the one passage to the other to exert a rotative force on the rotor. As a pump, the rotor is turned to increase and then decrease the volume of the cells. As the cell volume increases, one passage of the pair communicating therewith experiences decreased pressure to remove a quantity of fluid from a reservoir. Subsequently, as the cell volume decreases, the fluid is forced out of the other passage.

The vane urging means may comprise channels in the rotor, in the end caps and/or in the housing for selectively applying high pressure fluid to the vanes within the slots in the rotor. Moreover, a similar means may be provided to selectively apply radially inward forces to the vanes to prevent too great frictional forces between the vanes and the chamber wall which can cause "banging" or rough operation.

A second type of fluid device typified in Barriger (U.S. Pat. No. 120,231) is similar, except that inward and outward radial sliding of the vanes is purely mechanical, being effected by tenons or cam followers formed on the vanes which ride in cam slots formed in the end caps. Here, the pressure chamber may or may not have enlarged portions, pressure cells being defined in any event between adjacent, outwardly moved vanes.

It has been found that the majority of fluid devices constructed in accordance with the prior art, described above, do not usually satisfactorily operate as motors in high torque, low speed modes. Consequently, the use of such fluid devices as motors requires the gearing down of the shaft speed which adds to overall cost. Moreover, many of the prior art fluid devices do not satisfactorily operate as both motors and pumps. Consequently, certain fluid systems involving both fluid motor and fluid pump functions require the use of two fluid devices again adding to total cost.

Moreover, because of the radially inward and outward movement of the vanes, the total size of prior art fluid devices is rather large compared with the size of the rotors. Specifically, the inward and outward sliding movement of the vanes requires that the pressure chamber have a certain maximum diametrical dimension sufficiently large to accomodate the outwardly moved vanes. Because of the high pressures involved and because the housing for the chambers requires a certain amount of mechanical strength, this large diametric size of the chambers leads to the large, cumbersome size of the present fluid devices.

Additionally, the facilities described above for maintaining the vanes in contact with the chamber walls (and for counterbalancing this maintenance force to prevent a drastic increase in frictional forces) are often quite complicated. This complication again adds to the total cost of such a fluid device. However, if such facilities are not present, the vanes, not being positively controlled in their movement against the chamber walls, will often "skip" at high speeds. The Barriger-type of motor partially avoids "skipping", but as other types of prior art fluid devices, is quite physically large because of the need to accommodate inward and outward vane movement beyond the periphery of the rotor.

SUMMARY OF THE INVENTION

It is therefore an object of the present invention to provide a new and improved rotary fluid device and more particularly to provide an improved rotary fluid device of the sling vane type in which the difficulties, high cost, and large size of the prior art fluid devices are obviated or eliminated.

Another object of the present invention is the provision of a rotary fluid device (motor/pump) of the sliding vane type in which vanes slide parallel to the axis of rotation of a rotor, rather than radially thereof, which device, when used as a motor, provides high torque at low speed, and which, in addition, may also provide lower torque at higher speed and can also conveniently and effectively serve as a fluid pump.

Further objects of the present invention include the provision of a novel rotary fluid device which is smaller in size than types hitherto known and which exhibits increased efficiency and higher output power for a given amount of input.

With these and other objects in view, the present invention contemplates a new and improved rotary fluid device (motor/pump) of the sliding vane type. The new and improved fluid device of the present invention is similar to those of the prior art in that it has a rotor held within a chamber and a plurality of vanes mounted in radial slots for sliding movement in the rotor. The vanes, the rotor, and the walls of the chamber together define a plurality of varying volume pressure cells. However, in the fluid device of the present invention, the vanes are mounted in the rotor for sliding movement parallel to the rotational axis of the rotor; that is, from side to side rather than radially toward and away from the rotational axis of the rotor as in the prior art.

In the preferred embodiment, the vanes are positively and mechanically slid from side to side in the rotor in a direction parallel to the rotational axis of the rotor by a pair of opposed cam plates in the chamber. The cam plates have irregular complementary cam surfaces facing each other on opposite sides of the rotor. Opposed edges of the vanes continuously bear against both of these surfaces.

Means may be provided for communicating high pressure transmitted to one of the pressure cells to the two vanes defining it so that high frictional forces between the vane edges and the cam surfaces are decreased and so that "skipping" of the vanes over the surfaces are prevented.

BRIEF DESCRIPTION OF THE DRAWINGS

The present invention may be better understood by reference to the drawings appended hereto in which:

FIG. 2 is a sectional view taken along line 2—2 of FIG. 1 showing in greater detail certain elements normally maintained internally within the fluid device housing in accordance with the principles of the present invention;

FIGS. 4, 4A, 4B and 4C are varying views of a vane, a plurality of which are slidably held in the rotor of FIGS. 3A–3F and FIGS. 5A, 5B and 5C are views of cam plates present in the fluid device of the present invention which have irregular surfaces for effecting the sliding movement of the vanes of FIGS. 4, 4A, 4B and 4C.

DETAILED DESCRIPTION

Preferred Embodiment — Structure

Figure 1:
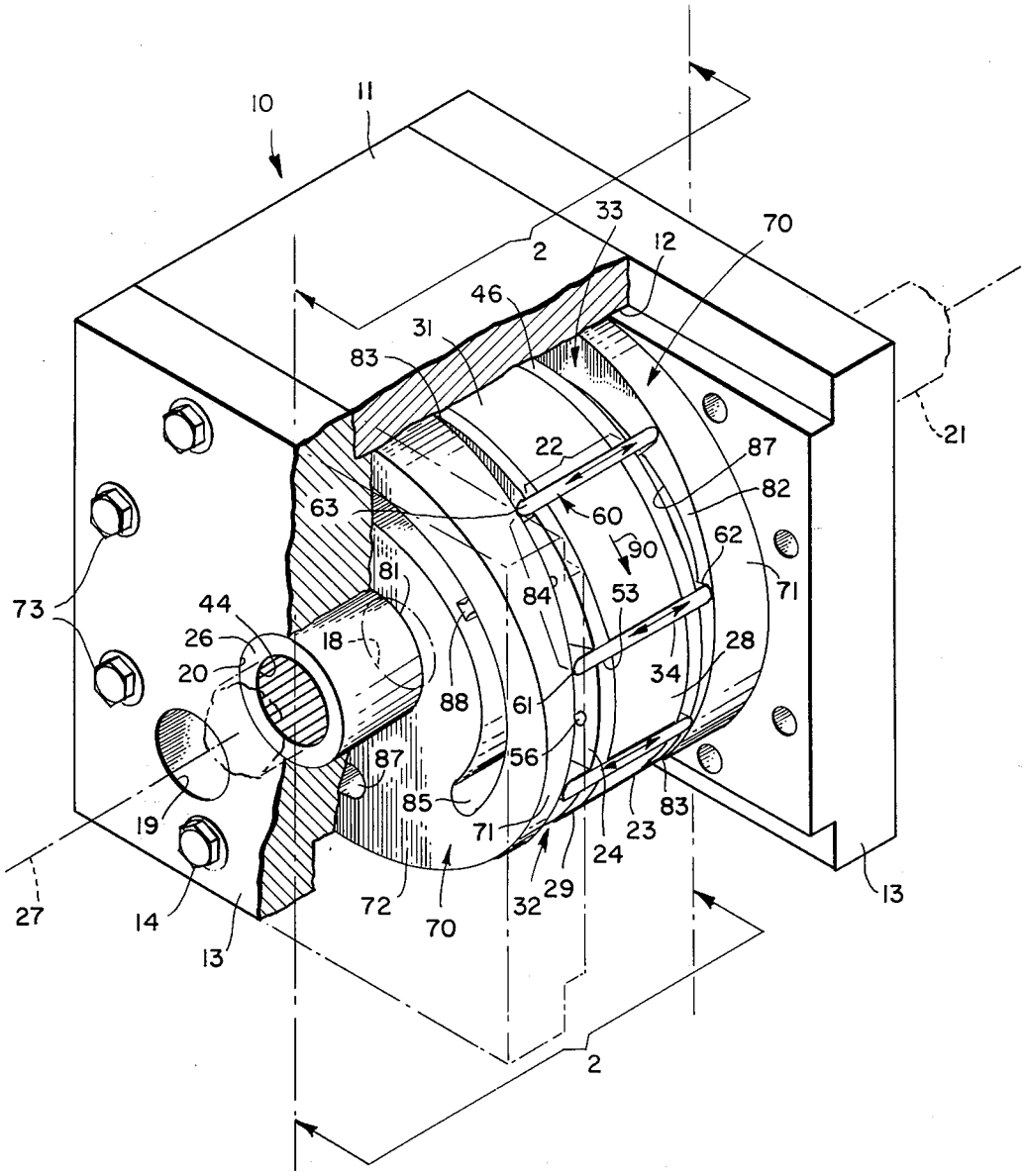
FIG. 1 is an overall view of the fluid device in accordance with the present invention with portions of a housing thereof being broken away to show the internal structure thereof as well as details of the various elements therein.

Referring first to FIGS. 1 and 2, a preferred embodiment of the fluid device 10 of this invention is shown as including a housing 11 having an open, generally right circular cylindrical chamber 12 therewithin. The chamber 12 is closed by a pair of end caps 13 which are rigidly attached to the housing 11 by any convenient expedient, such as bolts 14 which engage tapped holes 16 in the housing 11.

Each end cap 13 contains a pair of diametrically opposed apertures 18 and 19 which may be internally threaded. The apertures 18 and 19 serve as inlets and/or outlets to which hydraulic lines (not shown) are connectible by threading the ends of male members (not shown) thereinto.

As will be described more fully below, when the fluid device 10 us used as a motor, one of the end cap apertures 18 is connected to a high pressure hydraulic line. The other aperture 19 in the sameend cap 13, from which aperture fluid exits, is connected to a low pressure hydraulic line. The apertures 18 and 19 of the other end cap 13 are similarly connected.

Also, as described in greater detail below, the fluid device 10 us usable as a reversible motor. Accordingly, if the connections to the apertures 18 and 19, just described, are reversed, the fluid device 10 still operates as a motor, but rotates in an opposite sense.

Moreover, the fluid device 10 is operable as a reversible pump. In one rotational direction one end cap aperture 18 is an outlet while the other aperture 19 on the same cap 13 is an intake, the apertures 18 and 19 on the other end cap 13 functioning similarly. In the other rotational direction, the roles of the apertures 18 and 19 reverse.

Each end cap 13 also contains a bore 20 through which passes a drive shaft 21. The drive shaft 21 provides motive power when the fluid device 10 is used as a motor, and is driven by a source of motive power when the fluid device 10 is used as a pump.

The closed, right circular cylindrical chamber 12 holds a rotor, generally designated 22, which is fixed to the drive shaft 21. The rotor 22 has a generally right circular cylindrical periphery 23, a pair of opposite circular planar end surfaces 24, and a pair of hubs 26 oppositely extending away from the surfaces 24. The rotor 22 is rotatable on an axis 27, which is also the major axis of the chamber 12, of the drive shaft 21, and of the bore 20.

Figures 3A, 3B, 3C:
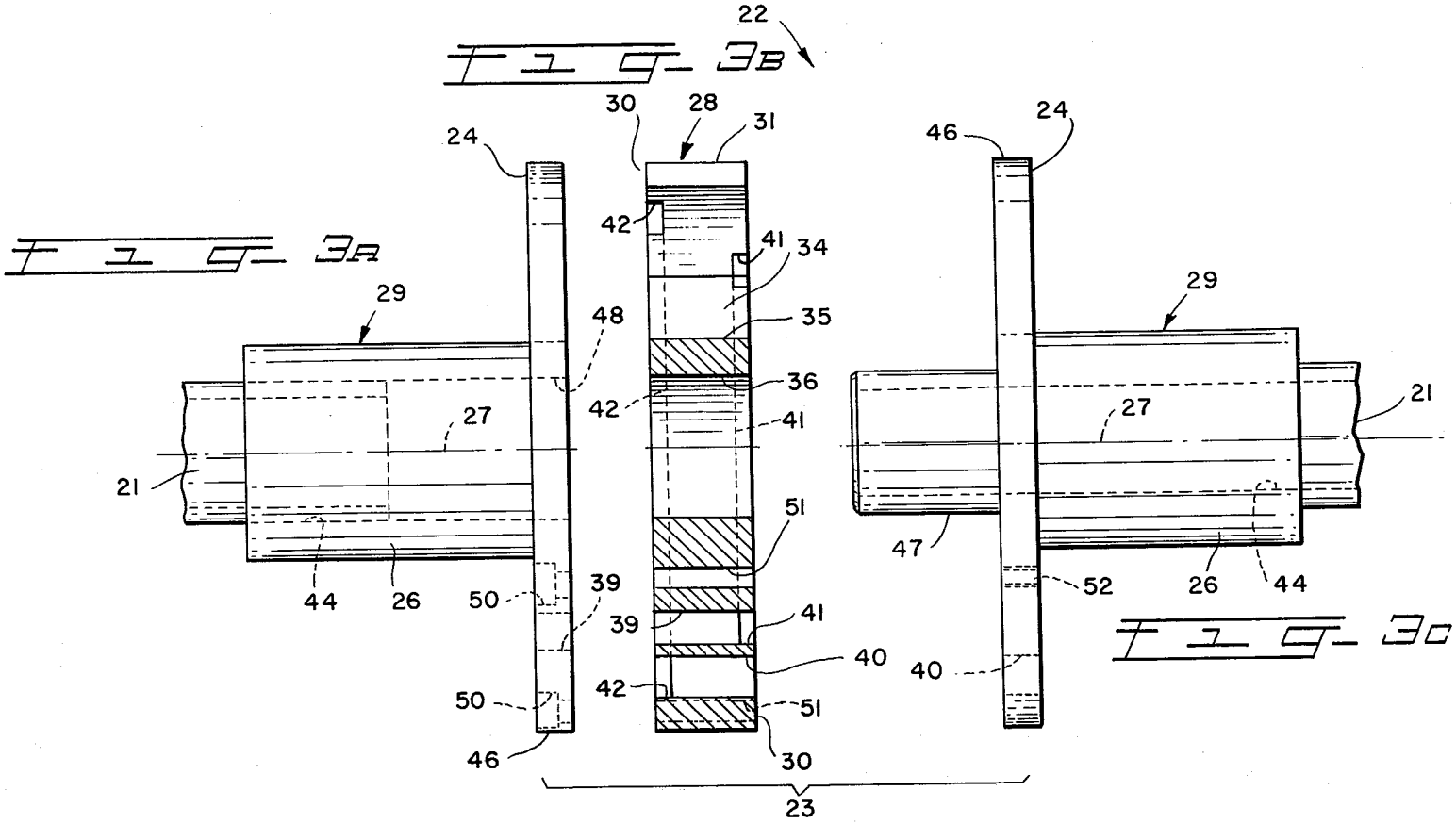
FIGS. 3A, 3B, 3C, 3D, 3E and 3F are front and side detailed views of the component parts of a rotor used in the fluid device of the present invention.

As shown in FIGS. 3A–3C, the rotor 22 is conveniently made up of a main body member 28 and a pair of rotor caps 29 between which the member 28 is sandwiched.

The main body member 28 is a generally right circular cylinder having a pair of opposed end surfaces 30 and a cylindrical periphery 31. The diameter of the member 28 is equal to the diameter of the chamber 12, so that the periphery 31 (and the periphery 23) is intimately, but slidably, engaged by the cylindrical wall of the chamber 12 upon rotation of the rotor 22 about the rotor axis 27. This intimate engagement of the body memeber 28 and the chamber wall effectively divides the chamber 12 into two generally cylindrical pressure chambers 32 and 33 of equal volume on either side of the rotor 22.

Figure 3D:
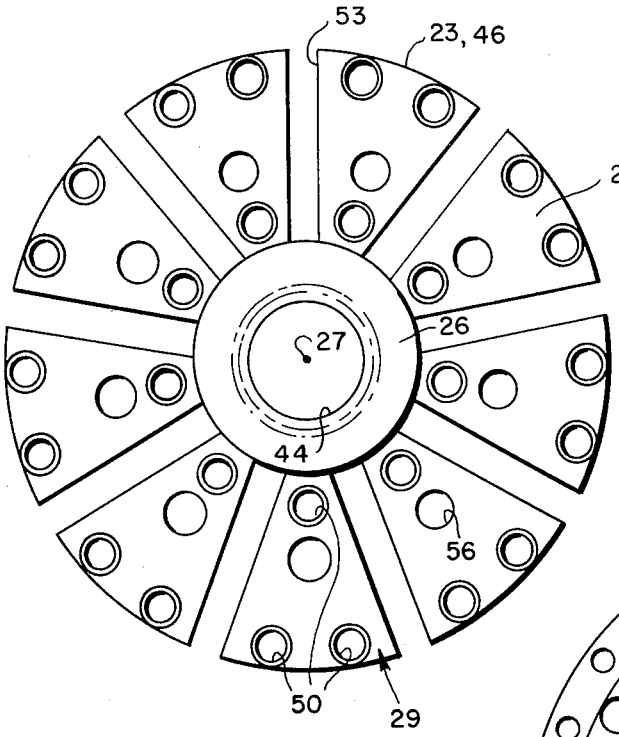
Figure 3E:
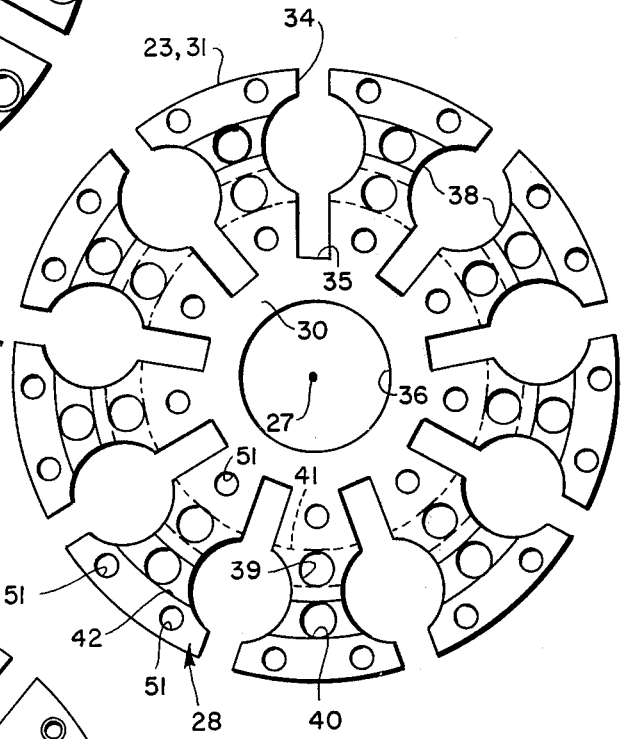

The main body member 28 (see also FIGS. 3D–3F) contains a plurality of regularly spaced slots 34 formed transversely through its end surfaces 30 and radially through its periphery 31 and extending toward, and on radii of, the axis of rotation 27 of the rotor 22. One or more slots 31 may be present, but an odd number, greater than one, such as the nine shown, is preferred, for reasons which will be described below. The slots 34 terminate in bottom surfaces 35, the circular array of which coaxially surround a central hole 36 formed in the main body member 28 coaxially with the periphery 31. The radial distance from the axis 27 to the bottom surfaces 35 of the slots 34 is equal to the radius of the hubs 26.

In this preferred embodiment, each of the slots 34 in the body member 28 contains a generally circular enlargement 38 more or less centrally between the bottom surface 35 and the periphery 31 and through the end surfaces 30. Preferably, the centers of the enlargements 38 define a circle coaxial with the central hole 36.

The main body member 28 also contains pairs of bores 39 and 40 therethrough between each slot 34. Preferably, the centers of the bores 39 and 40 in each pair lie on the same radius of the member 28, the inner bores 39 being closer to the center of the member 28 than the outer bores 40. The centers of the inner bores 39 preferably define a circle coaxial with the central hole 36, as do the centers of the outer bores 40, the latter circle being slightly larger.

Figure 3F:
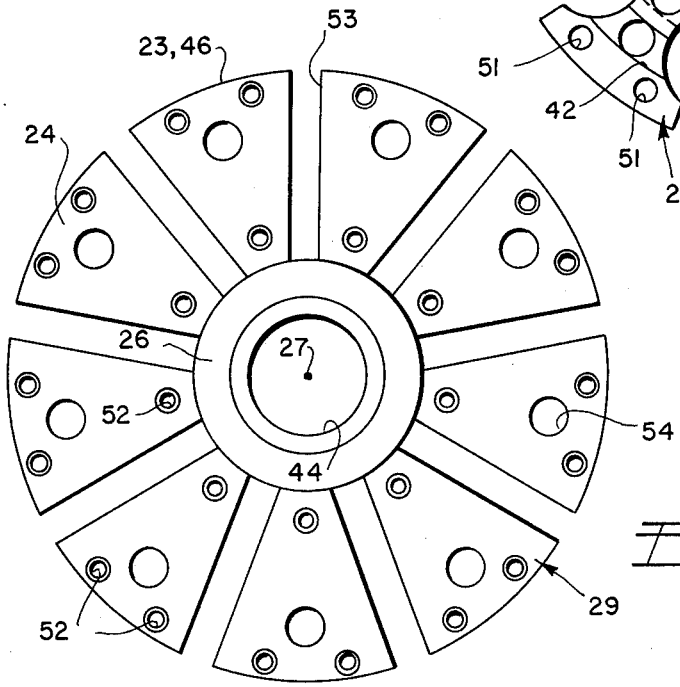
Figures 5A, 5B, 5C:
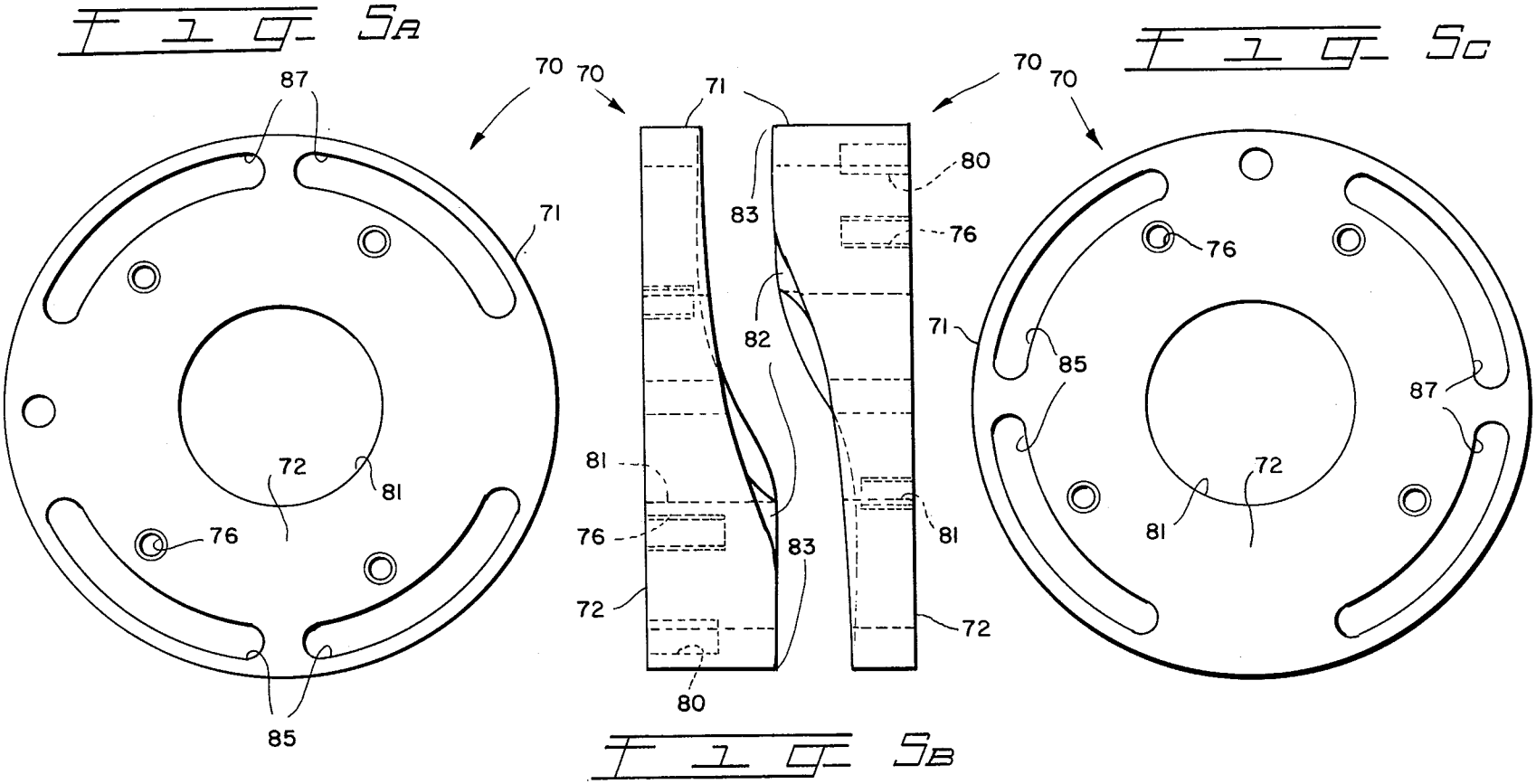

As shown in FIGS. 3A 3F, at one end of the inner bores 39 in one end surface 30 (here, the right-hand end surface) a first circular channel 41 is formed coaxially with the central hole 36. This channel 41 is discontinuous by virtue of its periodically intersecting the enlargements 38. At one end of the outer bores 40 in the other end surface 30 (here at the left-hand side) a second circular channel 42 is formed coaxially with, but having a slightly larger radius than, the first channel 41. The second channel 42 also periodically intersects the enlargements 38.

Attached to the end surfaces 30 of the main body member 28 are the generally cylindrical, rotor caps 29, the end surfaces of which are the end surfaces 24 of the rotor 22. The hub 26 on each cap 29 is cylindrical and contains a splined passageway 44 coaxial with the central hole 36 and with the circular periphery 46 of the cap 29. The cap peripheries 46 are continuous with the periphery 31 of the member 28 and together form the rotor periphery 23.

Attachment of the rotor caps 29 may be effected by any convenient means. In this preferred embodiment, one of the caps 29 contains a second hub 47 extending away from the hub 26. The hub 47 has the same diameter as, and fits into, the central hole 36 through the main body member 28 and into an enlargement 48 of the passageway 44 in the other cap 29. The length of the hub 47 is slightly greater than the thickness of the main body member 28. After the hub 47 is inserted into the hole 36 and the enlargement 48, the caps 29 with the member 28 sandwiched therebetween, are fastened together by bolts 49 or the like passing through aligned, unthreaded apertures 50 and 51 in one of the caps 29 and in the member 28 and threaded into aligned tapped apertures 52 in the other cap.

Each rotor cap 29 includes slots 53 through the thickness thereof which align with and form a continuation of the slots 34 in the member 28.

Portions of the caps 29 between the slots 53 close the enlargements 38 at either end thereof. One of the caps 29 also closes the first channel 41 on the right end surface 30 of the member 28. This end cap 29 contains bores 54 therethrough which align with the outer bores 40. The other end cap 29 closes the second channel 42 on the left end surface 30 and contains bores 56 therethrough which align with the inner bores 39.

As described more fully below, a fluid entering a bore 54 in one cap 29 passes therethrough and through the aligned outer bore 40 into a portion of the second channel 42 closed by the other cap 29 and adjacent the end of the bore 40. The fluid is free to flow in opposite directions through the channel 42 into the enlargements 38 on either side of the end of the bore 40. As will be seen, the fluid path from a given bore 40 ends here, because each slot 34 and enlargement 38 is closed by a sliding vane 60 held in the slots 34 and 53.

Similarly, a fluid entering a bore 56 in the other rotor cap 29 passes through the aligned inner bore 39 into a portion of the first channel 41 closed by one cap 29.

The enlargements 38, the bores 39, 40, 54, and 56, and the channels 41 and 42 all co-act, as described later, to function as pressure-equalizing, end-thrust-preventing facilities. Such facilities may not be desired or necessary and the enumerated elements may, in alternative embodiments, be eliminated. In such event, the rotor 22 becomes a simple affair comprising merely a slotted, right circular sylindrical member with a central hole, possibly splined, for engaging the drive shaft 21, as should be apparent.

As shown in FIGS. 4, 4A, 4B, and 4C, a plurality of the vanes 60 are maintained, one in each of the slots 34, 53, for side-to-side sliding therein parallel to the rotor axis 27. The vanes 60 are generally orthogonal, planar members having parallel side edges 61 (left) and 62 (right) and parallel top and bottom edges 63 and 64, respectively, which are perpendicular to the side edges 61 and 62. The vanes are so dimensioned that the bottom edges 64 conform to, and intimately and slidingly engage, the bottom surfaces 35 of the slots 34 as well as the cylindrical periphery of the hubs 26. The top edges 63 may be slightly curved to form a continuation of the periphery 23 of the rotor 22. The vanes 60 are wider between the side edges 61 and 62 than the axial thickness of the rotor 22, as described below, the edges 61 and 62 being machined to form a sealing, sliding engagement with any conformal surface they abut.

Each vane 60 contains a rectangular cut-out 66 therethrough. Each cut-out 66 holds a generally circular piston disc 68 therein, the disc 68 extending away from the opposed surfaces of the planar vanes 60 by substantially equal amounts. The discs 68 are mounted to the vanes 60 in the cut-outs 66 and the vanes 60 are then slid onto their slots 34 in the member 28 prior to attachment of the rotor caps 29. Such positioning locates the discs 68 in the enlargements 38, the walls thereof being sealingly but slidingly engaged by the disc edges, with the slots 34 and the enlargements 38 completely closed by the vane 60, disc 68 combination. The rotor caps 29 are then assembled to the member 28.

The vanes 60 also close the channels 41 and 42 where these latter intersect the enlargements 38. Accordingly, fluid applied to the bores 54 in the cap 29 on the right side of the rotor 22 passes through the bores 54 and 40, through the channel 42, and into the two enlargements 38 on either side of each bore 40 to apply force to the left sides of the piston discs 68 in these two enlargements 38. Such force tends to move the associated vanes 60 in a rightward direction toward the right rotor side, for a purpose described below. Similarly, fluid applied to the bores 56 from the left side of the rotor 22, and communicated to the right sides of the discs 68 by means of the bore 39 and the channel 41, tends to move the vanes 60 in the leftward direction.

On either side of the rotor 22 within the chamber 12 is a cam plate 70. The cam plates 70 border the respective pressure chambers 32 and 33.

Referring to FIGS. 1, 2, and 5A–5C the cam plates 70 may be seen to be generally cylindrical members having diameters equal to the diameter of the chamber 12, and peripheral surfaces 71 which closely interfit with the cylindrical wall of the chamber 12. An outside wall 72 of each cam plate 70 conforms to the inside wall of its associated end cap 13, so that the walls 72 are in intimate contact therewith. The cam plates 70 are held in their pressure chambers 32 and 33 by any convenient means such as by bolts 73 passing through unthreaded holes 74 in the end caps 13 and threaded into tapped holes 76 in the cam plates 70. Accurate location of the cam plates 70 may be ensured by one or more locating studs 78 which fit into aligned holes 79 and 80 in the end caps 13 and the cam plates 70, respectively. The plates 70 contain bores 81 coaxial with the rotor axis 27 for passage therethrough of the hubs 26. The hubs 26 and/or the shaft 21 may be appropriately journalled, as by bearings, in the bores 81 and/or the bore 20, as should be apparent.

Interior, facing cam surfaces 82 of the cam plates 70 are irregular but complementary to each other. Preferably, the cam surfaces 82 are formed such that the distance of all points on a radius from the axis 27, traveling thereover in a circular path about the axis 27, varies by the same amount with respect to a plane normal to the axis 27. Preferably, this variation is harmonic (sine- or cosine-related) although other types of variation may obviously be used.

As noted above, the surfaces are complementary. Stated differently, the length of any imaginary line segment maintained parallel to the axis 27 and intersecting the surfaces 82 of the two cam plates 70 remains constant as the line segment moves at a fixed radius about the axis 27. Moreover, in the preferred embodiment, the periodicity of the surfaces 82 is such that all such imaginary lines are the same length. Thus, an orthogonal planar surface defined by radii of the axis 27, such as the vanes 60, may be rotated about the axis 27 while remaining in constant contact with both surfaces 82. As may now be seen, the width of the vanes 60 is the distance between the surfaces taken parallelly to the axis 27.

As the rotor 22 turns, the configuration of the surfaces 82 causes the vanes 60 to periodically slide back and forth within the slots 34, 51. All of the vane edges 61–64 remain in intimate contact with, and slide over, their respective mutual mating surfaces. As seen most clearly in FIG. 1, there is a protruding portion 83 of each surface 82 which slides the vanes 60 until the adjacent side edge 61 or 62 thereof is coincident with the end surface 24 of the rotor 22. These portions 83, one on each surface in the preferred embodiment, are diametrically opposed, that is, 180° apart. The surface portions 83 contact both of the vane side edges 61 or 62 and, depending on their annular sweep, some of the end surface 24 on either side thereof. The end surfaces 24 thus slide over these surface portions 83.

Accordingly, with the rotor 22 and the cam plates 70 in place within the chamber 12, the pressure chambers 32 and 33 are bounded by the cylindrical wall of the chamber 12, the hubs 26, the end surfaces 24 of the rotor 22 and the cam surfaces 82, including the surface portions 83. Each pressure chamber 32 and 33 is, in turn, divided into a plurality of variable volume, generally pie-wedge-shaped pressure cells or compartments 84. Each pressure cell 84 is bounded by the facing surfaces of adjacent vanes 60 and by the described boundaries of the pressure chambers 32 and 33.

The volume of these cells 84 varies as the rotor 22 turns, due to the effect of the cam surfaces 82. In FIG. 1, for example, the cells 84 in the right-hand pressure chamber 33 have a minimum volume (approaching zero) at the bottom and increase in volume toward the top 180° away. The minimum volume cells 84 result, of course, from the proximity of the end surface 24 of the rotor 22 to the protruding portion 83 of the cam surface 82 at that position, the vanes 60 having slid to the left in their slots 34, 53 due to engagement of the right-hand vane side edge 62 by the portion 83 of the cam surface 82. At the top, the cells 84 in the right-hand pressure chamber 33 have a maximum volume, because the right-hand cam surface 82 is at its farthest from the right-hand end surface 24 of the rotor 22. Here, the vanes 60 defining the maximum have been moved fully to the right due to their contact between the left-hand side edge 61 and the left-hand cam surface 82 at the protruding portion 83 thereof.

The cells 84 in the left-hand pressure chamber 32 are complementary, that is, have their maximum volume at the bottom of FIG. 1 and their minimum at the top.

Each cam plate 70 contains a pair of ports 85 and 87 formed therethrough and arcuately elongated coaxially with the axis 27. One of the ports 85 has its central region overlain by the aperture 18 in the left-hand end cap 13, while the other port 87 is centrally overlain by the other aperture 19. The ports 85 and 87 in the right-hand cam plate 70 are similarly located with respect to the apertures 18 and 19. If needed for structural strength of the cam plates 70 (due to the high pressures involved), the ports 85 and 87 may be interrupted centrally by a web 88. This web 88 is smaller than the apertures 18 and 19 which, therefore, communicate with both halves of their underlying port 85 or 87. Fluid applied to the apertures 18 and 19 flows into and through the respective ports 85 and 87, and vice versa.

The ports 85 and 87 communicate also with the cells 84. Specifically, the ports 85 and 87 in each cam plate 70 span the arcuate course of, and communicate with, the majority of one-half of the cells 84 between the maximum an minimum volume cells 84. On each cam plate 70 the angle between adjacent ends or termini of the ports 85 and 87 is slightly greater than the angle between adjacent vanes 60. In this embodiment, where nine vanes 60 are used, and the angle between adjacent vanes 60 is about 40°, the angle between the adjacent ends of the ports 85 and 87 is about 45°. Thus, at no time does any one cell 84 communicate simultaneously with both ports 85 and 87. Moreover, as should be apparent, the only thrust or torque developed (assuming one port 85 or 87 is high pressure while the other port 87 or 85 is at low pressure) is on the vanes 60 located between adjacent termini of different ports 85 and 87 at a position generally diametrically opposite to the portion 83 of the cam surface 82.

It should be noted that in the motor mode where the number of ports 85 and 87 in each cam plate 70 is even (here, two) and the number of vanes 60 is odd (here, nine), dead centering is avoided. Specifically, when one cell 84 in one of the pressure chambers, say 32, is centered between the adjacent ends of different ports 85 and 87 so that the two vanes 60 defining that cell have no thrust thereon, in the other pressure chamber 33 a single vane 60 is somewhere between the adjacent ends of different ports 85 and 87 and the thrust thereon turns the rotor 22. Thus, there is always one vane 60 with thrust thereon.

FIRST EMBODIMENT — OPERATION AS A MOTOR

To operate the fluid device 10 as a motor, the apertures 18 in both end caps are connected to a source of fluid under high pressure, while the apertures 19 are connected to a low pressure or to a fluid reservoir. Such connection applies high pressure fluid to the ports 85 in each cam plate 70 and low pressure to the ports 87. Cells 84 adjacent the ports 85 are filled with increasing amounts of fluid as their volume increases due to turning of the rotor 22. Cells 84 adjacent the ports 87 force fluid therein out of these ports 87 as their volume decreases. Whenever any single vane 60 lies between the ends of adjacent ports 85 and 87, it has a force exerted thereon tending to rotate the vane 60 and the rotor 22 in a direction running, adjacent the maximum volume cells 84, from the high pressure (port 85) toward the low pressure (port 87). This direction is indicated by the arrow 90 in FIG. 1. Rotation of the rotor 22 rotates the shaft 21.

If the apertures 18 and 19 are pressurized in a reverse sense, i.e., apertures 19 to a source of high pressure fluid and aperture 18 to low pressure, the rotor 22 rotates in the direction opposite to the arrow 90.

As long as pressurization of the ports 85 and 87 in either sense continues, rotation of the rotor 22 continues. Such operation of the fluid device 10 as a motor provides low speed, high torque output. Generally, in the motor mode, both ports 85 are connected to a single high pressure fluid source and both ports 87 to a single low pressure, or vice versa. Speed may be increased and torque decreased by connecting only one port 85 to high pressure fluid and the port 87 in the same cam plate 70 to low pressure.

In a sliding vane motor typified by the prior art the chamber diameter was 3.3 in; chamber and rotor lengths were 1.31 inches; and rotor diameter was 2.71 inches. Thus, total displacement was 3.66 in.$^3$/rev, with a maximum vane extension beyond the rotor of 0.312 inches (9 vanes having extended areas of 0.41 in.$^2$).

In a fluid device 10 according to the present invention having a chamber 12 of the same dimensions and supporting the same amount of vane 60 area within the rotor 22 at full vane extension, vane extension of 0.437 is achieved. Total displacement is 6.5 in.$^3$/rev, a 77.6 percent increase over the prior art motor.

Because of the high pressure on a vane 60 fully extended from the rotor 22 when positioned between the adjacent ends of the ports 85 and 87 in one of the pressure chambers 32, a high force on this vane 60 is exerted. This high force not only moves the vane 60 to rotate the rotor, but also tends to slide the vane 60 toward the other pressure chamber 33. This tendency has the effect of adversely affecting the seal between the vane side edge 61 and the cam surface 82 and of "locking" the opposite vane side edge 62 against the cam surface 82 due to high frictional forces.

The conjoint operation of the enlargements 38, the piston discs 68, the bores 39, 40, 54, and 56, and the channels 41 and 42 obviates this effect, termed "end thrust". Specifically, and again considering the vane 60 fully extended from the rotor 22 in the pressure chamber 32, one cell 84 on one side e.g., the left side of the vane 60 is highly pressurized. Accordingly, high pressure fluid is applied also to the aligned bores 56 and 39 terminating in such cell 84 and ultimately to the channel 41 on the right side of the rotor 22. From there the high pressure fluid is applied to the right sides of the piston discs 68 of the two vanes 60 on either side of the bores 56 and 39, one of which vanes 60 is the vane under consideration. The resulting leftward force on the disc 68 opposes the tendency toward rightward "end thrust", discussed above, by urging the left side edge 61 of the vane 60 against the left side cam surface 82 in the pressure chamber 32. The area of the discs 68 is selected so that the "end thrust" ]is counterbalanced.

Balancing of the "end thrust" also leads to smooth, even operation of the motor 10 by preventing "skipping" of the vanes 60 and by preventing the vanes 60 from "locking" on transitional portions of the cam surfaces 82. The smooth transitions of the preferred harmonic configuration of the surfaces 82 also contributes to this smooth operation by minimizing the side-to-side acceleration and deceleration of the vanes 60.

PREFERRED EMBODIMENTS — OPERATION AS A PUMP

Rotation of the shaft 21 by a motive power source causes the fluid device 10 to act as a pump. If such rotation is in the direction of the arrow 90, the apertures 18 are intakes (low pressure) and the apertures 19 are outlets (high pressure). Reverse rotation reverses these roles.

Specifically, as cells 84 move past the ports 85 their volumes are increasing, creating low pressure therewithin. Such low pressure lowers the pressure at the apertures 18, effecting the intake of fluid from a reservior connected thereto into the cells 84. As the fluid-filled cells next pass the ports 87, their volumes decrease, increasing the pressure within the cells 84 and forcing fluid from the apertures 19. "End thrust" is again prevented by the transmission of low pressure to the discs 68.

ALTERNATIVE EMBODIMENTS

Various alternatives to the preferred embodiment are encompassed hereby. The rotor 22 may be a unitary member with or without the "end thrust" prevention facilities although formation of the channels 41 and 42 might prove quite difficult unless the rotor comprised several pieces such as the member 28 and rotor caps 29. Also the end caps 13 and the cam plates 70 may be made as a unitary member. The shape of the cam surface 82 need not be harmonic (sine-related). The vanes 60 need not necessarily be orthogonal as long as their side edges 61 and 62 are in constant contact with the cam surfaces 82. More or fewer vanes 60 and more or fewer ports 85 and 87 may be used, which either ignore "dead centering" problems or which further alleviate its effects by appropriate matching of an odd number of vanes 60 with even numbers of ports, or vice versa. Also more or fewer pressure chambers 32, 33 may be present within the housing 11 by appropriate formation of the cam surface 82.

Because many other changes and modifications may be made without departing from the spirit and scope of the claims herein, it is intended that all matter in the above specification shall be considered as illustrative only and not in a limiting sense.

What is claimed is:

1. An improved rotary fluid device of the type having a rotor received in a chamber defined by a chamber wall; a plurality of vanes mounted, one in each of a plurality of slots formed in the rotor, for side-to-side sliding movement in the slots in an axial direction, parallel to an axis of rotor rotation; means within the chamber for sliding the vanes from side to side in said axial direction upon rotation of the rotor; the rotor, chamber wall and vanes together dividing the chamber into a plurality of variable volume cells; and means for serially introducing fluid into and for serially receiving fluid from the cells as the rotor rotates, wherein the improvement comprises:

means, operated by fluid pressure, for opposing the tendency of the fluid within the cells to slide the vanes in said axial direction within the slots.

2. The fluid device of claim 1 wherein the opposing means comprises:

a pair of radially extending surface areas on each of the vanes, located axially inwardly of the axial ends of each vane, each of the radially extending surface areas on each vane facing a different axial side of the rotor; and fluid passage means in the rotor for communicating each of the cells with that radially extending surface area, on each vane bordering such cell, which faces the opposite side of the rotor from such cell.

3. The fluid device of claim 1 wherein the opposing means comprises:

said rotor including a plurality of slot enlargements, one in each slot;

a disc extending from each vane and conformally held in the corresponding enlargement; and means for applying the fluid in each of the cells to a selected side of each disc so as to oppose the tendency of the fluid in the cell to slide the vanes in the slots.

4. The fluid device of claim 3 wherein the applying means comprises:

bores formed in the rotor and running between each cell and a side of the discs extending from the vanes defining such cell, the disc side facing generally away from such cell.

5. A fluid device comprising:

a. a chamber wall defining a chamber;

b. a rotor mounted for rotation in the chamber so that an outer surface of the rotor is in sliding contact with the chamber wall, the rotor including a plurality of radial slots;

c. a plurality of planar vanes respectively held in the rotor slots for side-to-side sliding motion in an axial direction parallel to an axis of rotation of the rotor, a plurality of pressure cells each being defined by the sides of the rotor, the chamber wall and adjaent vanes;

d. means responsive to rotation of the rotor for selectively sliding the vanes side-to-side in said axial direction to selectively vary the volume of the cells;

e. a first port communicating simultaneously with selected cells;

f. a second port communicating simultaneously with cells other than the selected cells; and g. means, operated by fluid pressure, for opposing the tendency of fluid within the cells to slide the vanes in said axial direction within the rotor slots.

6. The fluid device of claim 5 wherein the opposing means comprises:

a pair of radially extending surface areas on each of the vanes, located axially inwardly of the axial ends of each vane, each of the radially extending surface areas on each vane facing a different axial side of the rotor; and fluid passage means in the rotor for communicating each of the cells with that radially extending surface area, on each vane bordering such cell, which faces the opposite side of the rotor from such cell.

7. The fluid device of claim 5 wherein the opposing means comprises:

said rotor including a plurality of slot enlargements, one in each rotor slot;

a disc extending from each vane and conformally held in the corresponding enlargement; and means for applying the fluid in each of the cells to a selected side of each disc so as to oppose the tendency of the fluid in the cell to slide the vanes in the rotor slots.

8. The fluid device of claim 7 wherein the applying means comprises:

bores formed in the rotor and running between each cell and a side of the discs extending from the vanes defining such cell, the disc side facing generally away from such cell.

* * * * *